United States Patent [19]

DeSousa

[11] 4,158,975

[45] Jun. 26, 1979

[54] UNIDIRECTIONAL GRIPPING OPEN END WRENCH

[76] Inventor: Egas J. J. DeSousa, 35724 Old Homestead, Farmington Hills, Mich. 48018

[21] Appl. No.: 825,702

[22] Filed: Aug. 18, 1977

[51] Int. Cl.[2] ..... B25B 13/12

[52] U.S. Cl. ..... 81/179; 81/186

[58] Field of Search ..... 81/58.2, 128, 129, 179, 81/185, 186

[56] References Cited

U.S. PATENT DOCUMENTS

| | | | |
|---|---|---|---|
| 2,563,878 | 8/1951 | Sigsbey | 81/186 X |
| 2,721,493 | 10/1955 | Bergland | 81/179 |
| 2,797,600 | 7/1957 | Beaver | 81/179 |
| 3,198,041 | 8/1965 | Davis | 81/129 |
| 3,425,302 | 2/1969 | Davis | 81/185 |
| 3,695,125 | 10/1972 | Glass et al. | 81/179 |

*Primary Examiner*—James L. Jones, Jr.
*Assistant Examiner*—James G. Smith
*Attorney, Agent, or Firm*—Gifford, Chandler, VanOphem, Sheridan & Sprinkle

[57] ABSTRACT

An open end ratchet wrench having an arcuate cavity to receive a D-shaped member. The D-shaped member being movable between inner and outer ends of the cavity to either ratchet around a nut or bolt or to apply a tightening force.

4 Claims, 12 Drawing Figures

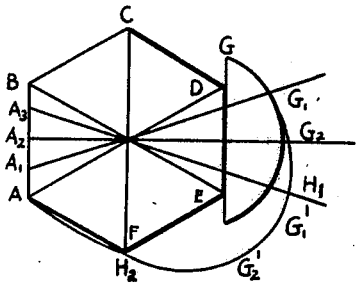
FIG-6
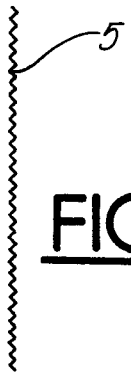
FIG-7
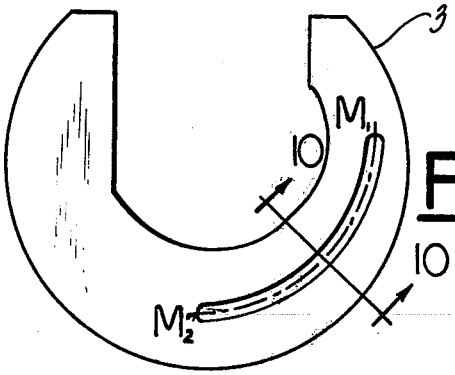
FIG-8
FIG9
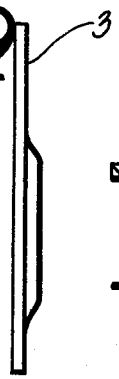
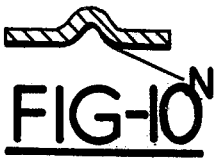
FIG-10
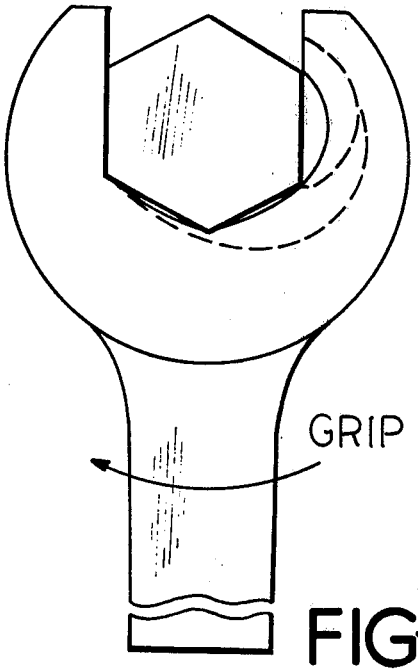
FIG-11
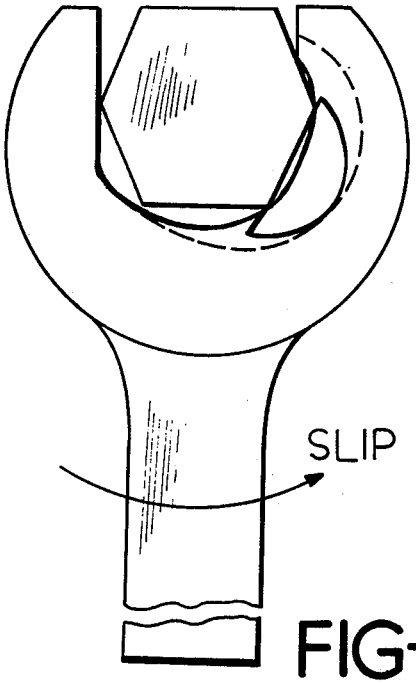
FIG-12

UNIDIRECTIONAL GRIPPING OPEN END WRENCH

BACKGROUND OF THE INVENTION

I. Field of the Invention

This invention relates to an open end type of wrench which while being used for tightening and loosening nuts and bolts grips in one direction and slips in the opposite direction.

Of all tools used for tightening nuts and bolts, the open end type wrench has always been accepted as unique from the viewpoint of economy, reliability, reach and maneuverability. Its main drawback has been that it cannot give the ratchet action so essential for fast work and a common feature of most closed end box or socket type wrenches.

SUMMARY OF THE PRESENT INVENTION

The principal object of this invention is to offer a tool with the advantages of the open end wrench as well as the box type wrench with the ratchet mechanism but without the built-in drawbacks of either of them.

Yet another object of this invention is to offer a tool with an adjustable type of jaw fitted with the unidirectional gripping mechanism that will increase many times over the versatility and the flexibility of this very useful tool over a fixed range of nut and bolt sizes.

With these and other objects in view, the unidirectional gripping wrench consists according to this invention of a metal flat bar with one end U-shaped, the distance between the two inside faces of the U being equal to the distance between the two opposite faces of the hexagon which comprises the nut or bolt head that is to be worked upon with this tool.

According to yet another feature of this invention, the inside face of one arm of said U-shaped end of the metal flat bar is machined to an exact profile specification described further on with respect to the drawings attached.

According to yet another feature of this invention, a D-shaped metal piece of an exact profile specification is held in the above-mentioned one arm by two cover plates also of an exact profile specification all described further on with respect to the drawings attached.

According to yet another feature of this invention, this D-shaped piece which is free to move in the cavity formed by the cut arm of the U and the two covers is normally positioned at the top of its run touching the top face of said cavity and with the straight side of the D parallel to the straight side of the opposite arm of said U end, by means of a helical compression spring also described further on with respect to the drawings attached.

BRIEF DESCRIPTION OF THE DRAWINGS

The invention will now be described with respect to the attached drawings in which:

FIG. 6 shows the geometrical method followed to obtain the profile of the inside face of the open end of the flat bar;

FIG. 7 shows the compression spring used to hold the D-shaped piece at the top of its run;

FIG. 8 shows the front elevation of the front cover plate;

FIG. 9 shows the side elevation of the cover plate of FIG. 8;

FIG. 10 shows a sectional view of the cover plate taken substantially along the line 10—10 in FIG. 8 and depicting the spring holding groove;

FIG. 11 shows the wrench in operation while gripping the nut; and

FIG. 12 shows the wrench in operation while returning to the normal position with the slip action.

DETAILED DESCRIPTION OF THE PREFERRED EMBODIMENT

Figure 1:
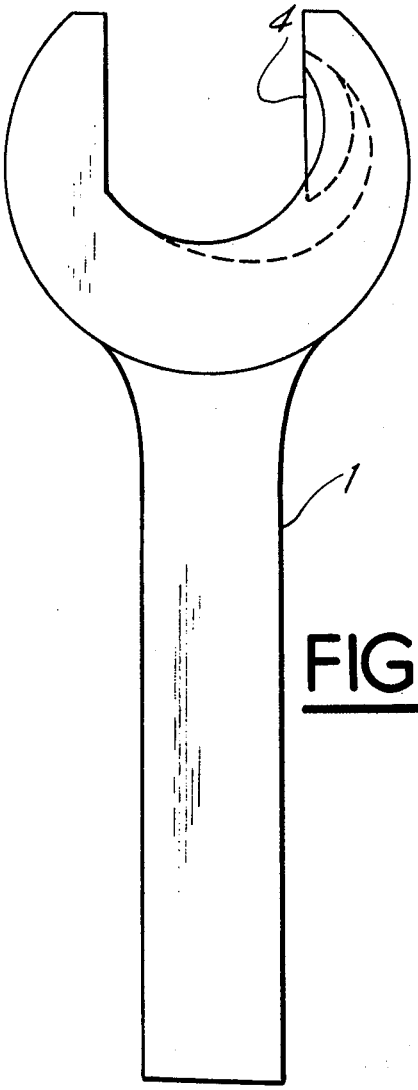
FIG. 1 shows the front elevation of the said wrench without the positioning spring.
Figure 2:
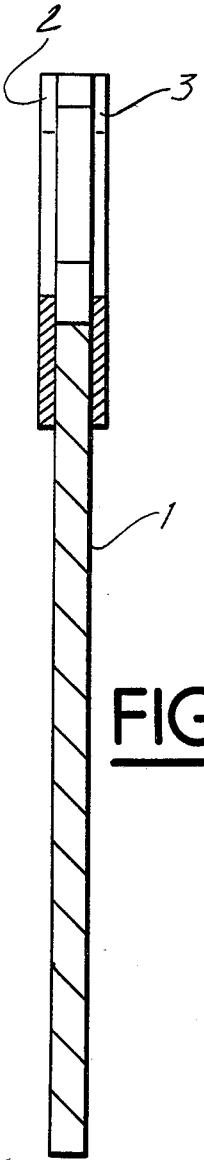
FIG. 2 shows the side elevation of the wrench shown in FIG. 1.

Turning now descriptively to the drawings in which like reference numerals indicate like parts, the wrench consists of a metal flat bar to which cover plates 3 and 2 are riveted or bolted in the position shown in FIGS. 1 and 2.

A D-shaped piece 4 is free to move in the cavity formed between the two cover plates 2 and 3.

Figure 4:
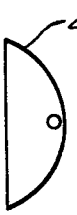
FIG. 4 shows the front elevation of the D-shaped piece.
Figure 5:
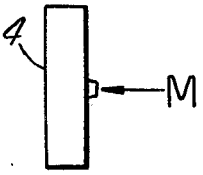
FIG. 5 shows the side elevation of the D-shaped piece.

A helical compression spring is housed in a groove $M_1M_2$ (FIG. 8) integrally formed in one of the cover plates 3 as shown in FIG. 9 and FIG. 10. This spring 5 butts against a cylindrical protuberance M which is an integral part of the D-shaped piece as shown in FIGS. 4 and 5. The spring action is to keep the D-shaped piece 4 at the top of the groove such that the straight edge of the D is parallel to the opposite straight arm of the U and to return it to this position whenever it is displaced while the wrench is being used.

We shall now describe the geometrical method used to obtain the profile of the inside face of the open end as well as the exact shape of the D-shaped piece.

Figure 3:
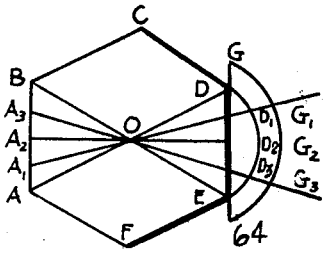
FIG. 3 shows the geometrical method followed to design the profile of the D-shaped piece.

In FIG. 3, ABCDEF is the hexagon that represents the nut which is to be worked with this tool. We turn it clockwise through 60 degrees so that the diagonal AOD occupies successive positions A1OD1, A2OD2, A3OD3, BOE. The locus of the point D is the curve DD1D2D3E.

This curve DD1D2D3E gives the profile of the inside faces of the cover plates shown in FIG. 8. It permits a nut as described above to turn without encumbrance.

A distance D2G2, for the sake of convenience kept equal to $\frac{1}{8}$ of the diagonal AOD, is added to this diagonal as shown in FIG. 3. GG1G2G3G4 is the locus of the point G obtained by turning the hexagon ABCDEF through 60 degrees so that the diagonal AOD occupies successive positions A1OD1, A2OD2, A3OD3, and BOE.

This figure GG1G2G3G4G gives the exact profile of the D-shaped piece.

To obtain the exact profile of the inner face of the open end of the tool, we consider FIG. 6.

ABCDEF is the hexagon comprising the nut as described above, GG1G2G3G4G is the D-shaped piece. We turn this set up through 60 degrees clockwise with the following constraints:

(1) Point A follows path AA1A2A3B, (2) Diagonal AOD passes through center O as the figure rotates, (3) The D-shaped piece GG1G2G3G4G is free to slide along the face DE of the hexagon so that in the end, its straight side GG4 lies along the side FE of the hexagon.

A curve is drawn to envelop the D-shaped piece as it is rotated through 60 degrees with the above constraints. This curve GG1G2H1G1'G2'H2A which gives the minimum space required for the 60 degrees turn gives the exact profile of the open end of the flat bar 1.

The following is the manner in which this tool is to be used: Holding the nut or bolt head between the arms of the wrench, we turn it in the clockwise direction whereby the D-shaped piece gets wedged between the inner face of the open end of the flat bar and the outer face of the nut or bolt head as shown in FIG. 11, as a result of which the nut or bolt head turns along with the wrench.

On reaching the extreme position, we turn the tool in the counterclockwise direction whereby the D-shaped piece slides over into the space provided as shown in FIG. 12 and the wrench is returned to the starting position without having turned the nut or bolt head along with it. The cycle is repeated till the nut or bolt head is tight or loose as desired.

If we turn the wrench upside down so that the D-shaped piece is now to the left side of the center line of the wrench, we notice that the directions of grip and slip are reversed, i.e. now the wrench grips in the counterclockwise direction and slips in the clockwise direction.

In this position following the procedure described in one of the preceding paragraphs, we can loosen or tighten a nut or bolt head as desired.

This type of wrench is to be fabricated to suit all types of common nut and bolt heads in various sizes. As used herein, the term "nut" shall collectively refer to a head with polygonal faces and includes such a head on a bolt, lag screw, internally threaded fastener and the like.

The preceding description is to be considered to be an illustration of the principle involved, by no means is it to be considered to limit the scope of said principle.

I claim:

1. An open end ratchet wrench comprising:

an elongated bar, said bar having a first and a second longitudinally outwardly extending fixed jaw at one end thereof, each jaw having an outer free end and an inner end, said jaws being substantially of equal length so that the free ends are in alignment with each other, said jaws being spaced apart from each other and having opposing surfaces parallel to each other and joined together along their inner end, said jaws defining a nut receiving recess therebetween;

said inner ends of said jaws including an arcuate wall section intermediate the parallel opposed surfaces defining an arcuate cavity open to said nut receiving recess, said arcuate wall section having a first end beginning at a point adjacent to but spaced inwardly from the free end of the first jaw and having its other end terminating at a point adjacent the inner end of the second jaw;

a flat, D-shaped member having a straight side and an arcuate side formed on a radius smaller than the cavity wall section, said D-shaped member being positioned within said cavity so that said straight side faces the nut receiving recess, said D-shaped member being movable within said cavity between the inner and outer ends of the arcuate wall section; and means for resiliently urging said D-shaped member toward the first end of the arcuate wall section, whereby with said D-shaped member in its outer position, the top edge of the straight side of said D-shaped member abuts against said first end of said arcuate wall section and is thus spaced from the free end of the jaw, and the top of said arcuate side cooperates with said arcuate wall section to align said straight side parallel to the opposing faces of said jaws, such that rotation of the bar in one direction rotatably drives a nut positioned in the nut receiving recess, the force from rotatably driving the nut being imparted to the free end of the first jaw via the D-shaped member, and whereby rotation of the bar in the opposite direction moves said D-shaped member toward the inner end of the arcuate cavity which permits said wrench to rotate with respect to the nut.

2. The invention as defined in claim 1 and including a cover plate secured to each side of the jaws, each plate having an opening in registration with the nut receiving recess wherein at least a portion of said D-shaped member is positioned between the cover plates.

3. The invention as defined in claim 2 wherein said D-shaped member includes an outwardly extending pin which is received in an arcuate channel formed in one cover plate to guide the D-shaped member within the arcuate cavity.

4. The invention as defined in claim 3 wherein said resilient means further comprises a helical spring disposed in said arcuate channel in the cover plate, wherein one end of the spring abuts agianst the pin.

* * * * *